US005762520A

United States Patent [19]

Martin

[11] Patent Number: 5,762,520

[45] Date of Patent: Jun. 9, 1998

[54] HERMAPHRODITIC WIRE COVER

[75] Inventor: Galen Monroe Martin, Jamestown, N.C.

[73] Assignee: The Whitaker Corporation, Wilmington, Del.

[21] Appl. No.: 640,295

[22] Filed: Apr. 30, 1996

[51] Int. Cl.[6] ..... H01R 13/58

[52] U.S. Cl. ..... 439/470

[58] Field of Search ..... 439/345, 350, 439/357, 471, 476, 465, 470

[56] References Cited

U.S. PATENT DOCUMENTS

| | | | |
|---|---|---|---|
| 4,108,527 | 8/1978 | Douty et al. | 339/107 |
| 4,125,312 | 11/1978 | Aimar | 339/107 |
| 4,180,304 | 12/1979 | Lerude | 339/196 M |
| 4,280,746 | 7/1981 | Ignatowicz | 339/107 |
| 4,358,178 | 11/1982 | Guy | 339/103 R |
| 4,372,634 | 2/1983 | Ritchie et al. | 339/17 C |
| 4,422,706 | 12/1983 | Neuhouser | 339/107 |
| 4,549,780 | 10/1985 | Bertini et al. | 339/107 |
| 4,606,596 | 8/1986 | Whiting et al. | 339/107 |
| 4,781,614 | 11/1988 | Ahroni | 439/391 |
| 4,900,277 | 2/1990 | Inaba et al. | 439/752 |
| 5,145,404 | 9/1992 | Beattie et al. | 439/521 |
| 5,383,794 | 1/1995 | Davis et al. | 439/357 |

*Primary Examiner*—Khiem Nguyen
*Assistant Examiner*—Eugene G. Byrd
*Attorney, Agent, or Firm*—B. J. Wolstoncroft

[57] ABSTRACT

A hermaphroditic wire guide (1) comprises shells (10,30) which are substantially identical. Wire guide (1) is arranged for connection to an electrical connector (40) such that the shells (10,30) will be moved laterally towards each other in registration with profiled rails (47) so that double beam latches (15) will latchingly engage respective latching projections (35). Hermaphroditic wire guide (1) advantageously reduces the number of parts required for a wire guide and provides reliable mechanical strain relief to a bundle of wires exiting electrical connector (40).

8 Claims, 2 Drawing Sheets

HERMAPHRODITIC WIRE COVER

The present invention relates to a wire guide and strain relief assembly for mounting to an electrical connector; more particularly, the present invention relates to a wire guide assembly with hermaphroditic, inter-changeable parts.

BACKGROUND OF THE INVENTION

Wire guides are typically used in the motor vehicle industry for the purposes of supporting and guiding a plurality of wires terminated to electrical connectors, for example, wires which comprise part of a motor vehicle wiring harness. The supporting function is important in protecting electrical terminations from strain acting on the conductors. The guiding function is important in environments where exposed machinery parts are in motion, for example, in the engine compartment of a motor vehicle. Improperly guided wires may become entangled in the moving machinery or engine parts and can be broken, or the entire wiring harness can be ripped apart in seconds. Wiring harness assemblies including wire guides should therefore be compact, and must reliably perform their functions in spite of the harsh conditions associated with use in a motor vehicle engine compartment, namely, mechanical vibration, temperature/heat cycling, and/or corrosive chemical vapors, fluids, gasses and etc. Moreover, an engine mechanic must be able to service the electrical components to which the wiring harness is interconnected, but do so with a minimum of disassembly/assembly time and effort. Finally, the wire guide should be produced and assembled at low cost.

A conventional wire guide assembly is disclosed in US-A-4358178 which comprises a two-piece assembly whereby the pieces are laterally slidable onto an electrical connector for providing strain relief to a bundle of wires terminated to the electrical connector. This two-piece design is undesirable because the two-pieces are not identical, and, therefore, the assembly requires two non-interchangeable parts for each assembly. Additionally, the latching structure of this two-piece design is subject to breakage when the two-pieces are mated over the connector. Moreover, the overall assembly is cumbersome to assemble because the two-piece design requires the electrical connector to be installed within the wire guide.

SUMMARY OF THE INVENTION

The present invention solves the foregoing problems by providing a wire guide assembly for use with an electrical connector: the assembly comprises two shells, each shell is engageable with an electrical connector for guiding a bundle of wires exiting from the electrical connector; and the shells are substantially identical for advantageously defining interchangeable parts.

For ease of assembly, the shells each comprise profiled structure for cooperating with complementary profiled structure formed on a wire exit side of the connector for assembling the wire guide assembly to the electrical connector. Additionally, each shell comprises a robust double beam latch member for securely latching the shells together. Moreover, each shell comprises a raised profile for interfitting engagement with a corresponding groove on the other of the shells, thereby defining a profile which prevents the ingress of water into the wire cover whereby the connector is made splash-proof.

DETAILED DESCRIPTION OF THE INVENTION

Figure 1:
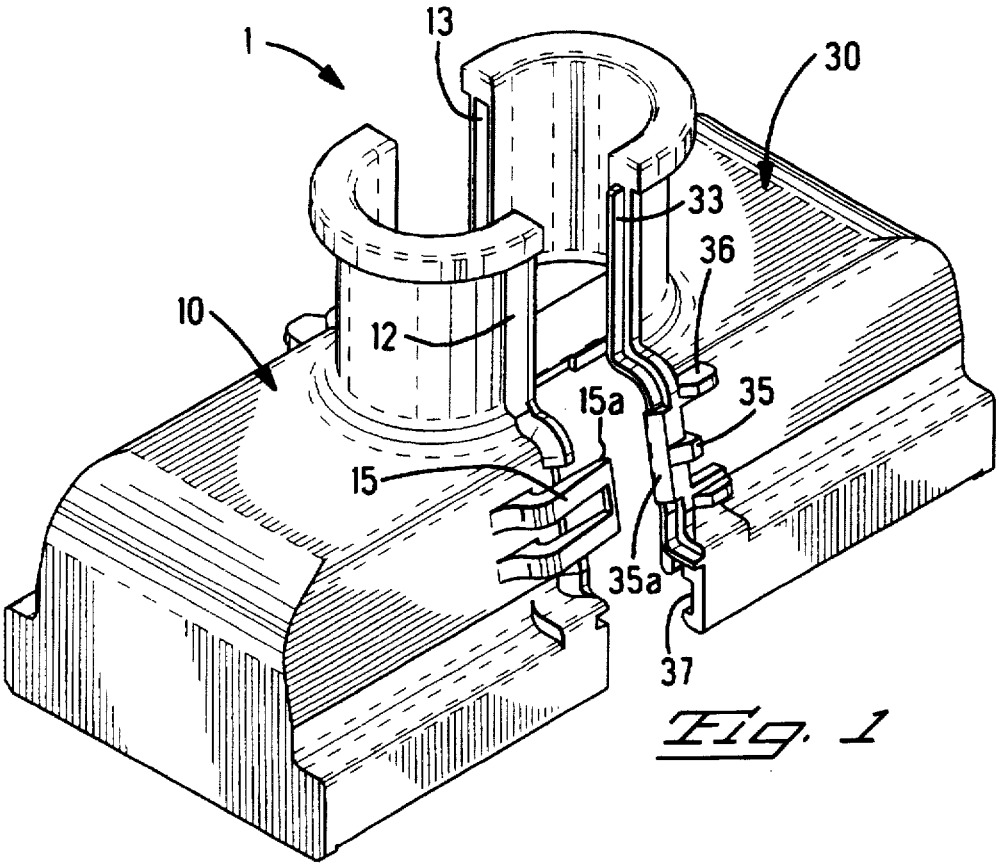
FIG. 1 shows an isometric view of the wire guide according to the present invention.
Figure 3:
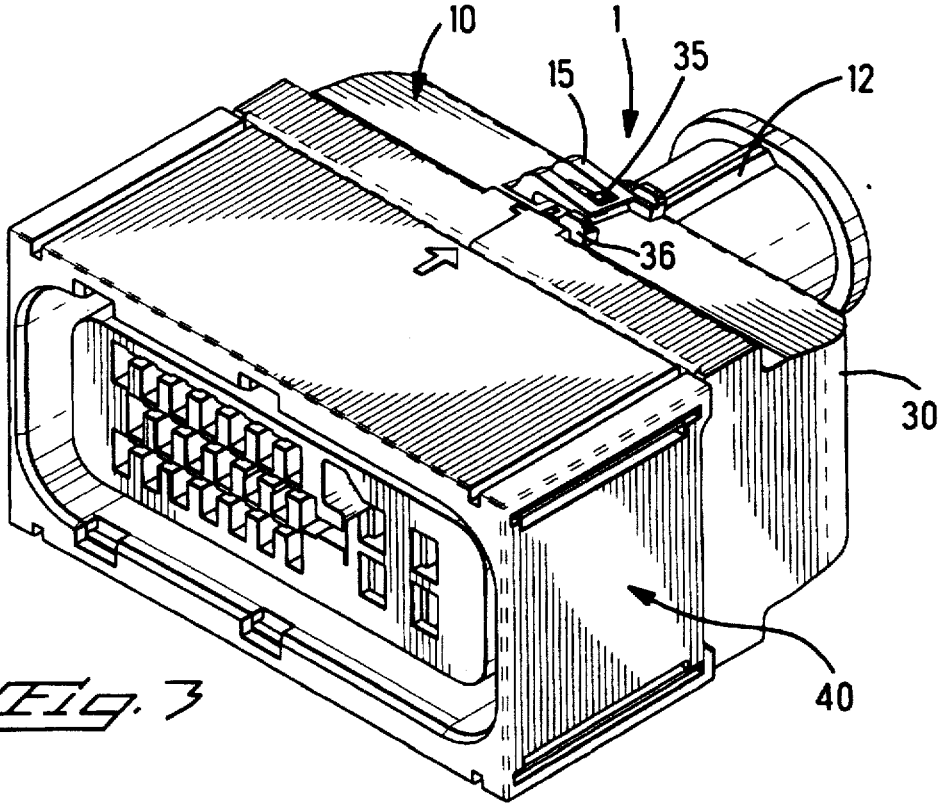
FIG. 3 shows an isometric assembly view of the wire guide of FIG. 2 in an assembled state.
Figure 2:
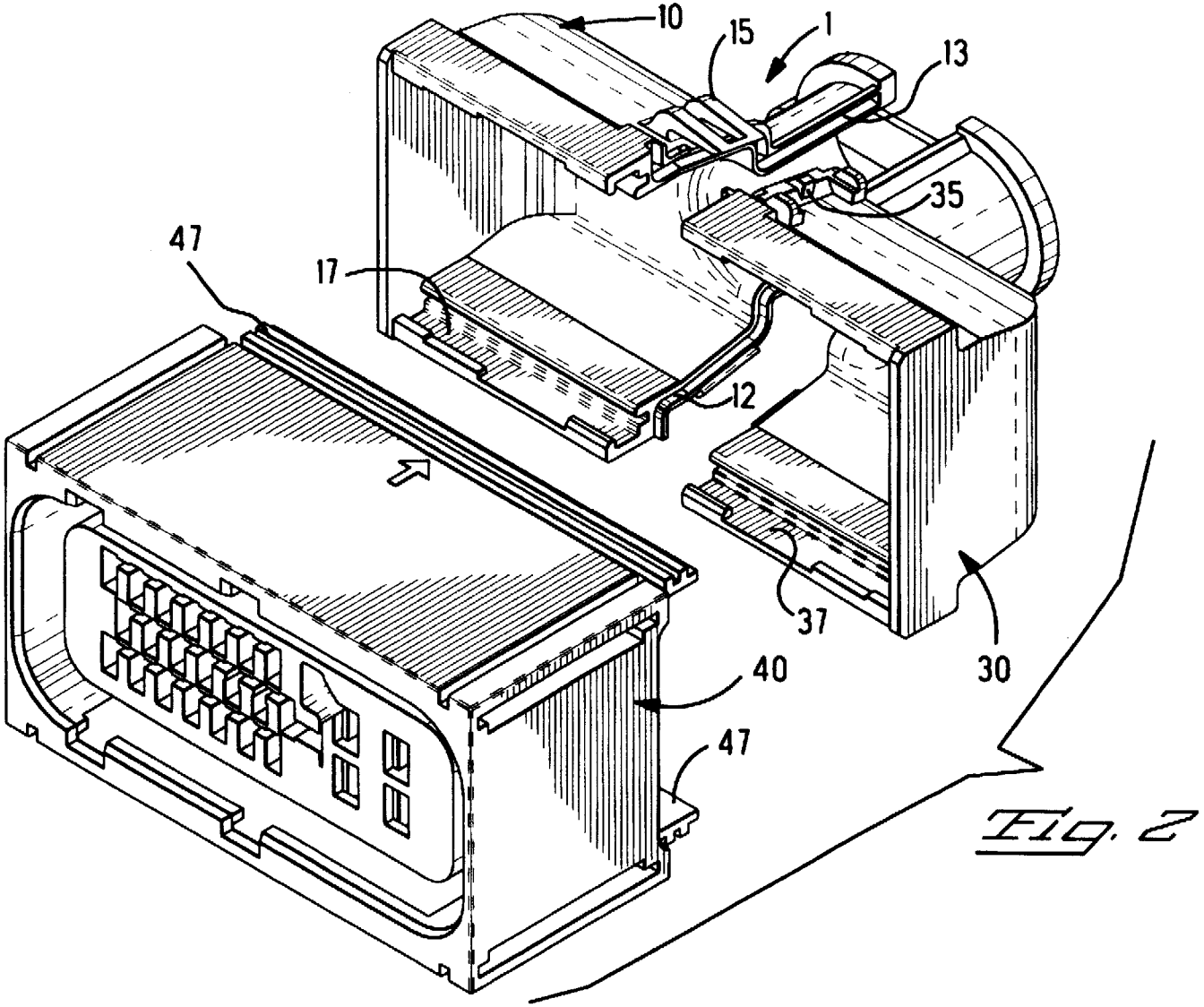
FIG. 2 shows an isometric view of the wire guide of FIG. 1 exploded away from an electrical connector for use therewith.

Referring to FIGS. 1–3, the wire guide 1 according to the present invention will be described. Wire guide 1 includes substantially identical shells 10 and 30, i.e. the shells are hermaphroditic and fully interchangeable so that one can be used in the place of the other. The inter-changeability of the shells is advantageous because it reduces the number of parts needed to form a wire guide. As shown in FIGS. 2–3, wire guide 1 is designed for use with an electrical connector 40.

Referring to FIG. 1, shell 10 includes: a shoulder 12; a recess 13 (as best shown in FIG. 2); a double beam latch 15 with a tapered lead section; and a profiled groove 17 as best shown in FIG. 2. However, it is to be understood that all of the features of shell 10 are likewise found on shell 30, and all of the features described for shell 30 have like structure on shell 10, thereby assuring that the shells 10,30 are hermaphroditic and interchangeable. Latch 15 has a tapered profile for the purposes of providing a positive latch mechanism, and uniformly distributing stress in the latch for ease of latching and unlatching. Shell 30 includes: a raised section 33; a latching projection 35 for latching engagement with double beam latch 15 of shell 10, and a tapered surface 35*a* for engagement with tapered lead 15*a;* raised projections 36 for located on either side of the latch 35 for protecting latch 35 from inadvertent unlatching; and profiled grooves 37 for registering with profiled sections of electrical connector 40, as further described below.

As shown in FIG. 2, profiled grooves 17,37 are shaped to receive profiled rails 47, which rails are formed on a wire exit side of connector 40. During assembly to connector 40, shells 10,30 will be aligned laterally of the side walls of connector 40, and shells 10,30 will be moved towards each other, with grooves 37 in registration with respective profiled rails 47. Double beam latches 15 will be aligned with corresponding latching projections 35, and the tapered lead sections 15*a* of each respective latch 15 will slidingly engage respective tapered surfaces 35*a* of projections 35 so that latch 15 will be deflected up and over latching projections 35. Latches 15 will then snap into place behind respective projections 35, thereby latching the shells 10,30 together (see FIG. 3). Raised projections 36 are positioned laterally of respective latching projections 35 for, for example, blocking wires which would otherwise tend to snag on the latch 15 or disengage the latch 15 from its respective latching projection 35. At this point, respective raised sections 33 will be aligned with and disposed in respective recesses 13 thereby defining a profile which prevents the ingress of water into the wire cover 30 whereby the connector 40 is made splash-proof.

Thus, while a preferred embodiment of the present invention has been disclosed, it is to be understood that the invention is not to be strictly limited to such embodiment but may be otherwise variously embodied and practiced within the scope of the appended claims.

Accordingly, what is claimed is:

1. An assembly comprising an electrical connector and a wire guide assembly attachable to the electrical connector;

the electrical connector having a wire exit side and rails extending from the top and the bottom of the electrical connector wire exit side between opposite ends of the electrical connector:

the wire guide comprising a hermaphroditic subassembly comprising two substantially identical shells including grooves adjacent a front surface, the rails on the electrical connector being received within the grooves to attach the wire guide to the electrical connector, the grooves and the rails being configured to form a sliding fit extending from the ends of the electrical connector so that the shells can assembled to the electrical connector from opposite ends of the connector and brought laterally into engagement; the hermaphroditic shells comprising hermaphroditic means for bundling wires, within the wire guide, centrally on the connector wire exit side: and hermaphroditic latches on each wire guide shell, the latches securing abutting shells together with the latches being on opposite sides of the wires bundled at the center of the wire exit side of the electrical connector.

2. The assembly of claim 1, wherein each shell comprises a double beam latch member.

3. The assembly of claim 2, wherein the double beam latch member is engageable with a sliding surface for deflection of the latch member.

4. The assembly of claim 2, wherein respective raised projections are disposed laterally of each respective latch for preventing inadvertent unlatching thereof.

5. The assembly of claim 1 wherein the rails extend rearwardly from the wire exit side of the electrical connector so that the wire guide is confined behind the electrical connector extending only over the rails.

6. The assembly of claim 1 wherein each shell includes raised projections and profiled grooves on interior edges thereof, raised projections and profiled grooves on each shell engaging respectively profiled grooves and raised projections on the other shell to form a splash proof wire cover where the shells meet to surround a bundle of wires.

7. The assembly of claim 6 wherein the raised projections and the profiled grooves extend between the front and the rear of the wire guide.

8. The assembly of claim 1 wherein the wire guide consists of only two hermaphroditic shells, these two hermaphroditic shells consisting of the means for bundling the wires within the wire guide, centrally on the connector wire exit side.

* * * * *